United States Patent [19]

Haltsonen

[11] Patent Number: 4,472,244

[45] Date of Patent: Sep. 18, 1984

[54] WIRE SECTION IN A PAPER MACHINE

[75] Inventor: Eino Haltsonen, Jyväskylä, Finland

[73] Assignee: Valmet Oy, Finland

[21] Appl. No.: 345,480

[22] Filed: Feb. 3, 1982

[30] Foreign Application Priority Data

Feb. 10, 1981 [FI] Finland ..... 810373

[51] Int. Cl.[3] ..... D21C 3/00; D21C 3/04

[52] U.S. Cl. ..... 162/300; 162/301; 162/312; 162/314

[58] Field of Search ..... 162/203, 204, 205, 300, 162/301, 312, 314, 308, 305, 349, 352, 310, 297

[56] References Cited

U.S. PATENT DOCUMENTS

| | | | |
|---|---|---|---|
| 3,846,233 | 11/1974 | Kankaarpaa | 162/312 |
| 3,942,433 | 3/1976 | Wohlfarter | 162/205 |
| 4,207,144 | 6/1980 | Zag et al. | 162/352 |
| 4,285,768 | 8/1981 | Schiel | 162/203 |

FOREIGN PATENT DOCUMENTS

| | | |
|---|---|---|
| 50649 | 2/1976 | Finland . |
| 782709 | 9/1977 | Finland . |

*Primary Examiner*—Steve Alvo

*Attorney, Agent, or Firm*—Steinberg & Raskin

[57] ABSTRACT

A wire section in a paper machine includes an upper wire unit which is compact and easily exchangeable, if required, the construction of the wire section being such that old, single-wire planar wire machines can be converted to twin-wire machines. The paper machine wire section includes a lower wire having an initial single-wire run in which dewatering of a web takes place, and at least one upper wire unit following the initial single-wire run which defines a twin-wire dewatering zone with an adjacent run of the lower wire and in which dewatering of the web takes place through both the lower and upper wires. The twin wire dewatering zone is further defined by a curved, solid-cover forming shoe situated within the upper wire loop and wherein the forming shoe is preceded by a curved dewatering zone where dewatering is mainly through the upper wire. The upper wire unit further comprises apparatus situated mainly above the forming shoe for conducting water dewatered from the web through the upper wire to at least one side of the paper machine substantially without the use of suction.

17 Claims, 5 Drawing Figures

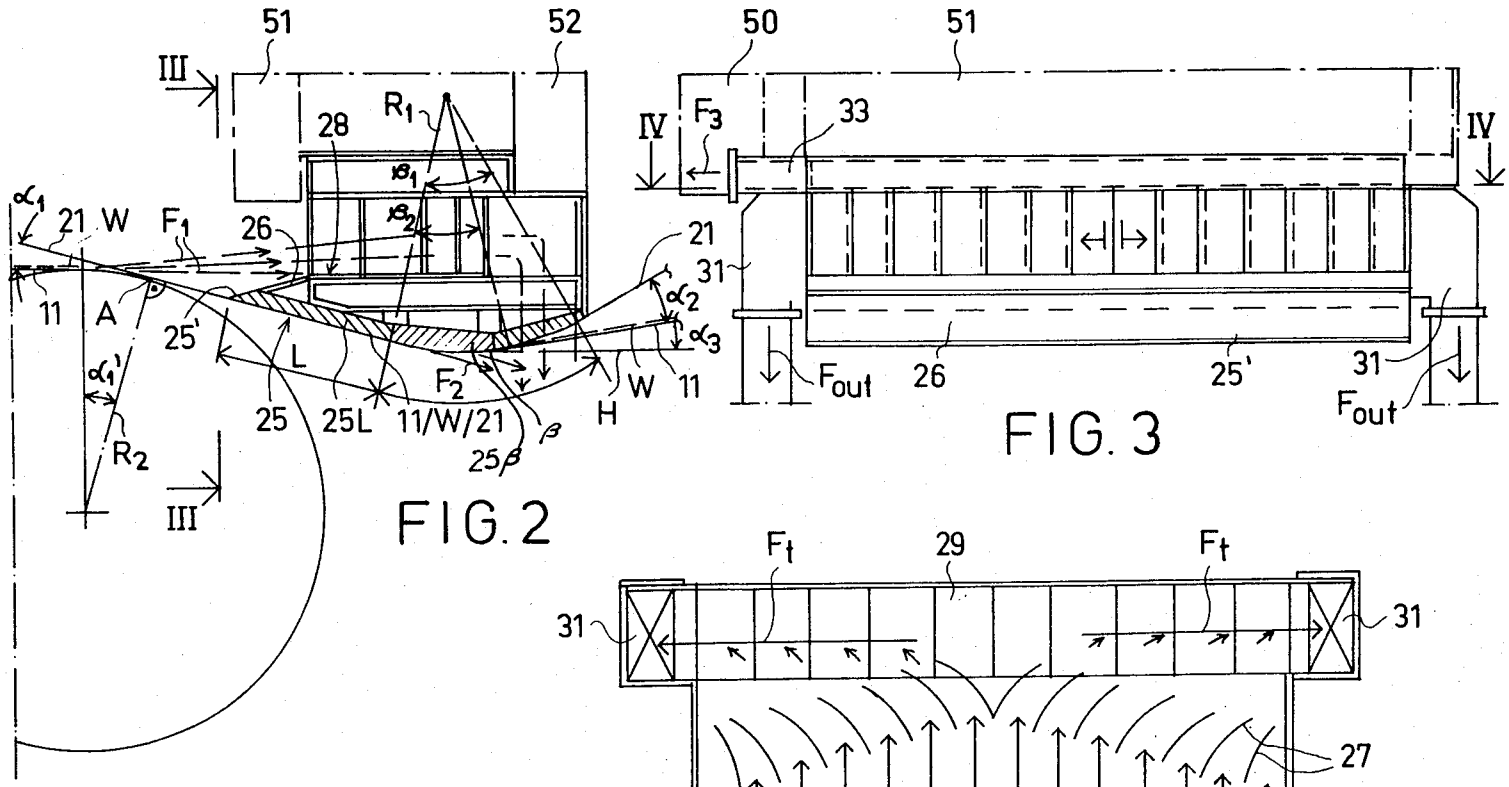
FIG. 3
FIG. 2
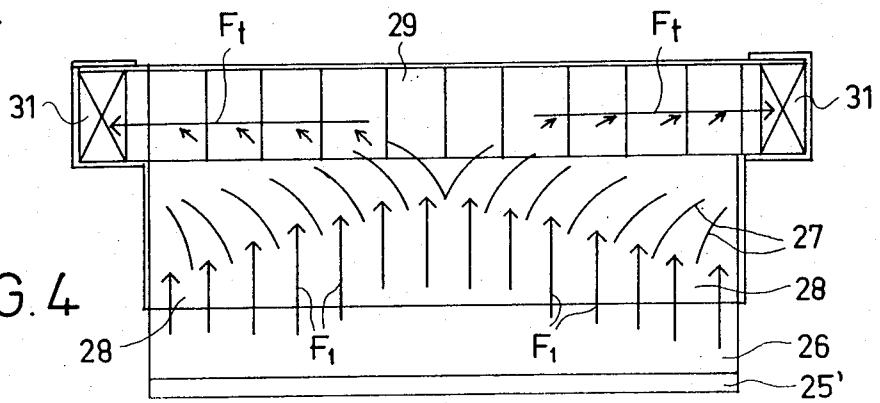
FIG. 4

WIRE SECTION IN A PAPER MACHINE

BACKGROUND OF THE INVENTION

The present invention relates to wire sections in a paper machine.

More particularly, the present invention relates to a wire section for a paper machine which includes a lower wire, such as a planar Fourdrinier wire in a paper machine being renovated, the lower wire having an initial single-wire run in which dewatering of the web takes place and at least one upper wire unit following the initial single-wire run which together with an adjacent run of the lower wire defines a twin-wire dewatering zone which is located mainly below the plane defined by the initial single-wire run of lower wire, and wherein dewatering takes place in the twin-wire dewatering zone, or at least in a part thereof, through both the lower and upper wires.

Regarding the state of the art associated with the present invention, reference is made to Finnish patent application No. 782709 of Beloit Walmsley Ltd., United Kingdom, and to Finnish Pat. No. 50 648 corresponding to U.S. Pat. No. 3,846,233 of Valmet Oy of Finland, assignee of the instant application.

SUMMARY OF THE INVENTION

One object of the present invention is to provide a new and improved wire section for a paper machine by the use of which an old single-wire machine can be converted to a two-wire machine so that a two-sided dewatering of the web can be achieved to provide the well-known desirable effects in the web forming process.

Another object of the present invention is to provide a new and improved wire section having an upper wire unit which is compact and which is easily exchangeable, when required, in order to change the upper wire or for other maintenance operations.

In accordance with the present invention, these and other objects are attained by providing that the twin-wire dewatering zone in the paper machine wire section described above is at least partially defined on the side of the upper wire unit or units by a curved forming shoe having a solid-cover situated within the wire loop of the upper wire unit, and wherein the forming shoe is preceded by a curved dewatering zone defined by a curved member, such as a forming roll, shoe-like member or the like, and in which dewatering takes place mainly through the upper wire. Moreover, the upper wire unit further comprises members disposed mainly above the forming shoe through which the water which has been dewatered from the web through the upper wire is conducted to the side or sides of the paper machine substantially without expending any energy on suction.

In a preferred embodiment, a large-diameter forming roll borders or defines the curved dewatering zone and a curved forming board at least partially defines the twin-wire dewatering zone and at the same time serves as an upper or top side water removal channel.

More particularly, in an advantageous embodiment of the present invention, the upper run of the lower wire with the pulp stock web carried thereupon is guided over the upper surface of the large-diameter forming roll in a downward direction so that through the effect of such curvature, water is drained through the upper wire in an upwards direction, while the underside surface of the same forming roll serves as a return roll. Dur to the relatively rigid structure of such a large-diameter forming roll, it is possible for such forming roll to at least partly counteract the wrinkling tendency of the web. Moreover, the use of a large-diameter forming roll advantageously allows the same to be carried directly on the foundation of the paper machine thereby avoiding the imposition of extra loads on the frame structures of old paper machines.

Where the invention is utilized in connection with modernizing or renovating a planar wire, the lower wire change arrangements may be retained. Furthermore, when the upper wire unit is constructed as an integrated entity, it is easy to lift the upper wire during wire changing or other maintenance operations to a specially designed location or onto a special stand. Alternatively, the beams of the upper wire unit can be constructed so that the beams are supported at one end and are provided on their other end with dismountable spacers thereby eliminating the necessity of moving the upper wire unit from its location for upper wire changing operations.

DESCRIPTION OF THE DRAWINGS

A more complete appreciation of the present invention and many of the intended advantages thereof will be readily appreciated as the same becomes better understood by reference to the following detailed description when considered in connection with the accompanying drawings in which:

FIG. 2 is an elevational view in partial section of the twin-wire web dewatering zone portion of the wire section of the present invention;

FIG. 3 is a section view taken along line III—III of FIG. 2;

FIG. 4 is a section view taken along line IV—IV of FIG. 3;

DESCRIPTION OF THE PREFERRED EMBODIMENTS

Figure 1:
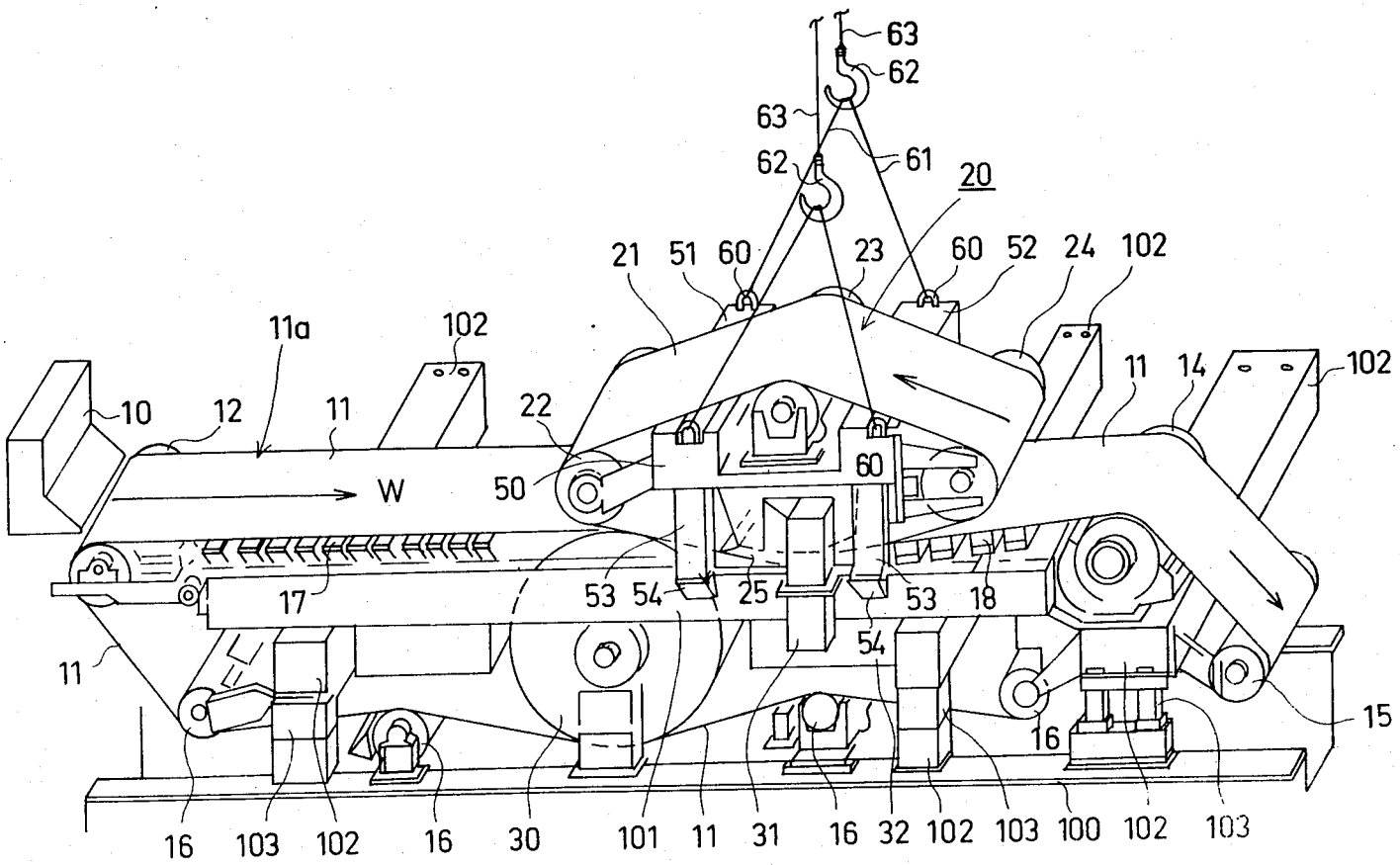
FIG. 1 is an axonometric perspective view of a wire section according to the present invention.

Referring now to the drawings wherein like reference characters designate identical or corresponding parts throughout the several views and, more particularly to FIG. 1, an embodiment of the invention is illustrated which is particularly adapted to be used in connection with the renovation or modernization of the planar wire section of a paper machine. It should be understood, however, that the arrangement of the invention illustrated in FIG. 1 can also be used as the wire section in a new paper machine. The following description of the embodiment of FIG. 1 will be in connection with its use for modernizing an old paper machine.

The wire section comprises the planar wire 11 of an old paper machine. The original run of the planar wire 11 is between the breast roll 12 and the suction roll 14. A headbox 10 is located at the beginning end of the wire section and following the headbox 10 is foil equipment 17 situated within the loop of the planar wire 11, the foil equipment being present from the old paper machine. The lower run of the loop of wire 11 is guided by a traction roll 15 and guide rolls 16 which are also components of the old paper machine. In a similar manner, the frame structure will also remain from the old paper machine. In the illustrated embodiment, the frame structure comprises a lower frame part 100, upper frame parts 101 and transversely extending beams 102 which, for example, may be cantilevered so as to project into the loop of wire 11. Conventional frame spacers 103 are provided at the ends of the transverse beams 102 which may be removed when it is desired to change the wire 11.

In the renovation and modernization of the conventional planar wire section in accordance with the present invention, an upper wire unit 20 is provided while certain dewatering elements and/or guide rolls originally associated with the planar wire section are replaced by a large-diameter forming roll 30 which guides the travel of both the upper and lower runs of the lower wire 11 as seen in FIG. 1.

The upper wire unit 20 includes its own frame component 50 which incorporates transversely extending beams 51 and 52 and downwardly extending vertical beams 53. In mounting the upper wire unit 20 outwardly projecting members 54 are provided on the beams 101 of the old paper machine and on which the lower ends of the vertical beams 53 are placed whereby the upper wire unit 20 is supported through the old paper machine frame. Moreover, in this manner the upper wire unit 20 can be lifted into its operating position as a single unit using an overhead crane in the paper machine hall or can be similarly lifted from its supports for purposes such as wire changes. FIG. 1 illustrates a typical arrangement for lifting the upper wire unit 20 including lift wires 63 terminating at lift hooks 62 which can be looped over lifting wires 61 whose ends are fastened to ears 60 fixed to the frame part 50 of upper wire unit 20.

The upper wire unit 20 includes an upper wire 21 which is guided in a loop around guide rolls 22, 23 and 24. Situated within the loop of the upper wire 21 is a solid-cover forming shoe 25 and, additionally, water collecting apparatus, the details of the forming shoe and water collecting apparatus being described in greater detail below.

The upper run of the loop of lower wire 11, which had previously been in a horizontal and straight direction in connection with the old paper machine, will, after the installation of the upper wire unit 20, be urged by a run of the upper wire 21 so as to form a downward "dell" or "valley" beginning at the forming roll 30. In other words, the upper wire unit 20 defines together with an adjacent run of the lower wire 11 a twin-wire forming zone. Referring to FIG.2, the twin-wire forming zone extends from point A where the upper and lower wires 21 and 11 first come together to a point B where the wires depart. Dewatering of the web carried through the twin-wire forming zone will take place in two directions, i.e., through both the upper and lower wires, thereby achieving the well-known desirable effects associated with two-sided dewatering. The upper wire 21 is guided to lap the roll 30 so as to lap the same in a tangential manner at point A, i.e., the upper wire 21 meets the web being carried on the lower wire 11 at point A. As seen in FIG.2, the lower wire 11 laps the forming roll 30 over an angle $\alpha'_1$. With the geometry of the embodiment illustrated in FIG. 2, the angle $\alpha'_1$ is substantially equal to the angle $\alpha_1$ at which the wires 11 and 12 approach each other.

Due to the change of direction $\alpha'_1$ of the lower wire 11 and the web supported thereby as they travel over the forming roll 30, water is drained from the web W through the upper wire 21 under the action of centrifugal force in the direction indicated by arrows $F_1$ in FIGS. 2 and 4. The water thus drained is collected in a water removal chute defined by the front edge 25' of the curved forming shoe 25, a wall portion 26 and a horizontal wall 28 forming the underside of the water removal chute. The front edge 25' of the forming shoe 25 has a blade-type configuration and may in certain instances serve the function of a foil or the like, doctoring water from the inner surface of the upper wire 21. A plurality of guide baffles 27 are supported on the horizontal bottom wall 28 which deflect the jets of water leaving the web in transverse directions as indicated by arrows $F_t$. A transverse chute 29 extends with a suitable inclination towards the sides of the paper section or former at which respective water drain chutes 31 are provided which serve to conduct the water which has been dewatered from the web through the upper wire 21 as described above onwardly in a manner known in the art and illustrated by arrows $F_{out}$ in FIG. 3. A save-all 31 (FIG. 1) is provided through which the water drained from the web W through the upper wire 21 ($F_1$) as well as the water dewatered from the web through the lower wire 11 in the region of the curved forming shoe 25 ($F_2$), which will be described in greater detail below, is collected and conducted onwardly in a known manner.

The details of the construction and operation of the curved, solid-cover forming shoe 25 forming a component of the upper wire unit 20 will now be described. Referring to FIG. 2, the forming shoe 25 includes a planar straight portion 25 L, the length of which is designated L, extending substantially from the tangency point A of roll 30 in the machine direction in a downwardly sloped direction. The straight portion 25 L is followed by a curved portion 25 $\beta$ which forms a continuation of the planar straight portion 25 L and whose end constitutes the trailing edge of the forming shoe 25. The outer surface of the curved portion 25 $\beta$ changes from a downward to an upward slope as seen in FIG. 2. Furthermore, in the preferred embodiment illustrated in FIG. 2, the curved portion 25 $\beta$ is formed of two separate, adjacent members which together define a smooth outer surface.

The upper wire unit 20 constitutes an integral unit comprising the frame components 50, 51, 52 and 53 on which the guide rolls 22, 23 and 24 are rotatably mounted and to which the forming shoe 25 is affixed. The water conducting apparatus which guides the water drained from the web W through the upper wire 21 to the sides of the paper machine is situated above the forming shoe 25. If required, a suction connector 33 (FIG. 3) may be associated with the water conducting apparatus through which air is drawn, designated by arrow $F_3$, through the water conducting apparatus in order to facilitate the disposal of the water being discharged from the web W, designated $F_1$.

Referring again to FIG. 2, the angle $\alpha_2$ comprises the angle at which the upper wire 21 separates from the lower wire 11. The angle $\alpha_3$ is the angle at which the lower wire 11 and the web W carried thereby defines with a horizontal plane H after the point B where the web W and the lower wire 11 separate from the curved sector or portion 25 $\beta$ of the forming shoe 25. The arrows $F_2$ in FIG. 2 indicate dewatering of the web through the lower wire 11 which occurs through the action of centrifugal force.

The geometry of the twin-wire dewatering region formed between the wires 11 and 21 has an important bearing on the efficiency of the dewatering and on the web forming process. It is understood that it is possible within the scope of the invention to vary the particular geometry of the twin-wire forming section from that illustrated in a manner such as required by the web being manufactured in each particular instance.

Still referring to FIG. 2, the angle $\alpha_1$ as well as the angle $\alpha'_1$, where these angles are substantially equal as in the case of the embodiment illustrated in FIG. 2, are preferably in the range of about 5° to 30°. It is within the scope of the invention to initiate the twin-wire run on the sector $\alpha'_1$ and in this case the angle $\alpha'_1$ will be greater than the angle $\alpha_1$.

The magnitude of the angle $\alpha_2$ is preferably in the range of about 5° to 30°, and most preferably about 20°. The angle $\alpha_3$ is preferably in the range of about 5° to 50°, and most preferably about 10°. The angle $\beta_1$ is preferably in the range of about 30° to 70°, and most preferably about 50°. The angle $\beta_2$ preferably has a magnitude of between about 20° to 40°, and most preferably about 30°. It should be understood, however, that the particular values of the angles set forth above should in no way restrict the scope of the present invention and have been set forth merely to illustrate preferred embodiments of the invention which are favorable under certain circumstances.

The forming roll 30 is preferably constituted by a roll having a smooth surface. However, various types of recessed surface rolls may also be utilized, such as grooved rolls or blinddrilled rolls. In the case where a recessed-surface roll is used as the forming roll 30, dewatering of the web will take place to some extent towards the forming roll 30 through the lower wire 11 as the same laps the forming roll 30 over the angle $\alpha'_1$. The roll 30 may in some instances be provided with a suction zone such, for example, by the provision of an external suction box, although the embodiment wherein the roll 30 has a solid shell and a smooth surface is most advantageous. Moreover, it is within the scope of the invention to utilize a solid-cover shoe in the region of the sector $\alpha'_1$ in lieu of the solid-shell roll 30 having the large diameter $2\times R_2$.

As discussed above, the curved forming shoe 25 has a solid cover and preferably a smooth surface. The water still present within the web W within the twin-wire run will tend to reduce the friction between the shoe 25 and the upper wire 21. The radius of curvature of the curved portion 25 $\beta$ of the shoe 25, designated $R_1$ in FIG. 2, is preferably relatively large so that the downwardly facing surface of the forming shoe 25 has a gentle curve. In an advantageous embodiment, the radius of curvature $R_1$ is substantially equal to the radius $R_2$ of the forming roll 30.

The provision of a large diameter forming roll, such as forming roll 30, is advantageous in that the same will undergo only minimal deflections which is advantageous in the counteracting of any wrinkling tendency of the wires. Another advantage is that the large diameter forming roll will at the same time function as a roll component which guides the lower run of the loop of the lower wire 11.

By virtue of the fact that the twin-wire dewatering zone of the wire section or former of the present invention is preceded by a single wire run 11*a* (FIG. 1), the dewatering of the web W can be commenced in a cautious manner utilizing those web forming, guiding and controlling means with which the paper maker is accustomed from conventional Fourdrinier machines. Prior to the initiation of the twin-wire dewatering zone at point A, the web W has had sufficient time to reach a suitable degree of felting so that at this point dewatering can take place in two directions in a vigorous manner. It is understood that through bidirectional dewatering, i.e., by dewatering the web through the lower wire 11 as well as through the upper wire 21, the distribution of fines in the direction of the thickness of the paper can be favorably influenced. In this connection, reference is made to applicant's Finnish Pat. Nos. 50 648, issued May 10, 1976, and 50 649, issued May 10, 1976.

Figure 5:
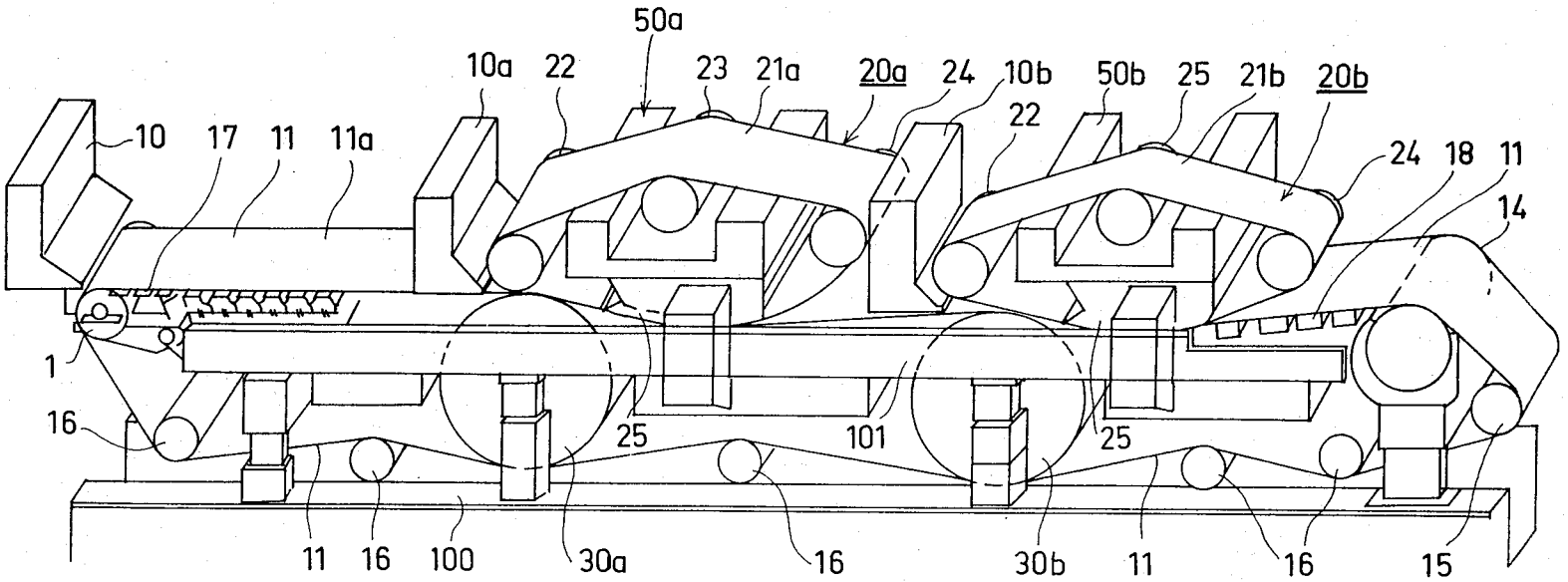
FIG. 5 is a view similar to FIG. 1 illustrating another embodiment of a wire section in accordance with the present invention, applied in a multi-ply web former.

Turning now to FIG. 5, a former or wire section according to the present invention for manufacturing a multi-ply web is illustrated. For example, the former or wire section illustrated in FIG. 5 may be used in connection with the manufacture of multi-ply cardboard. The apparatus comprises two upper wire units 20*a* and 20*b* associated with respective frame structures 50*a* and 50*b*. The construction of the upper wire units 20*a* and 20*b* is essentially the same as the construction of the upper wire unit 20 described above in connection with the previous embodiment. The wire section has a single-wire planar wire run 11*a* following a first headbox 10 for the same purposes as discussed above in connection with the first embodiment. Foil equipment 17 is similarly provided as shown.

A second headbox 10*a* precedes the first twin-wire dewatering run and the first upper wire unit 20*a*. The second headbox 10*a* supplies the pulp from which, for example, the middle layer incorporated in the cardboard being manufactured is supplied while the headbox 10 supplies the pulp for forming one of two outer plies of the cardboard. A third headbox 10*b* is situated substantially immediately after the upper wire unit 20*a* in the machine direction. The third headbox 10*b* supplies a jet of pulp stock before the second twin-wire unit 20*a*, for example, to form the other outer ply of the cardboard. Suction boxes 18 are situated within the loop of lower wire 11 following the second upper wire unit 20*b* in the machine direction, and similar suction boxes also being utilized after the upper wire unit 20 in the embodiment of the invention illustrated in FIG. 1. A former or wire section of the type illustrated in FIG. 5 may be used to manufacture products other than cardboard such, for example, as paper composed of a plurality of different pulp stock types, or otherwise by a plurality o headboxes.

As noted above, the embodiment of the invention illustrated in FIG. 5 utilizes two consecutive upper wire units 20*a* and 20*b*. However, it is understood that within the scope of the invention, more than two upper wire units may be provided and, additionally, additional headboxes may also be utilized according to the particular requirements at hand.

Through the use of one or more integrated upper wire units, e.g., units 20 (FIG. 1) and 20*a* and 20*b* (FIG. 5) in accordance with the present invention, an appreciable increase in dewatering efficiency is obtained relative to the efficiency obtained using a planar wire (Fourdrinier) machine. Moreover, the formation of the web W can be controlled more closely than was previously possible and thereby a web having improved properties can be obtained. According to the teaching of the present invention, it is possible to supplement a planar wire or Fourdrinier machine to provide it with the various advantages afforded by twin-wire formers while at the same time retaining the most important advantages of the planar wire machine associated with the single-wire forming section 11*a* thereof.

Since the upper wire units 20; 20*a* and 20*b* constitute integrated units according to the invention, they can be constructed and installed on existing planar wire machines in an easy manner. Furthermore, it is possible to advantageously effect the changing of the upper wires 21; 21*a* and 21*b* to take place using the crane found in the paper machine hold to lift the entire upper wire unit such, for example, for placement onto a stand or base at the side of the wire section provided for this purpose.

Obviously, numerous modifications and variations of the present invention are possible in the light of the above teachings. It is therefore to be understood that within the scope of the claims appended hereto, the invention may be practiced otherwise and as specifically disclosed herein.

What is claimed is:

1. In a paper machine, a wire section comprising:

a lower wire having an initial single-wire run in which dewatering of a web takes place;

at least one upper wire unit including an upper wire loop, said at least one upper wire unit following said initial single-wire run and defining a twin-wire dewatering zone together with an adjacent run of said lower wire, said twin-wire dewatering zone being mainly located below the plane defined by said initial single-wire run of said lower wire, and wherein dewatering of the web takes place in at least a part of said twin-wire dewatering zone through said lower wire as well as through said upper wire;

said twin-wire dewatering zone being partly defined by a curved, solid-cover forming shoe disposed within the wire loop of said upper wire unit;

said forming shoe being preceded by a curved dewatering zone defined by a curved member and wherein dewatering of the web takes place mainly through said upper wire, said curved member being constituted by a solid-shell forming roll having a smooth surface, said forming roll preceding said at least one upper wire unit to deflect the run of at least said lower wire over a certain angle; and wherein said at least one upper wire unit includes means situated mainly above said forming shoe for conducting water dewatered from the web through said upper wire to at least one side of the paper machine substantially without the use of suction energy, said watering conducting means comprising a chute assembly situated above said forming shoe within said upper wire loop, said chute assembly including curved guide vanes situated above said forming shoe, said vanes dividing the water dewatered from the web through said upper wire into two transverse directions.

2. The combination of claim 1 wherein said lower wire comprises a lower wire loop having upper and lower runs and wherein said forming roll is a large diameter roll and also constitutes means for guiding said lower run of the lower wire.

3. The combination of claim 1 wherein said upper wire is conducted into tangential relationship to said lower wire substantially in the region where said lower wire separates from said curved member.

4. The combination of claim 1 wherein said solid-cover forming shoe has in the direction of travel of the web a substantially planar portion followed by a curved portion having a radius of curvature in the region of which said lower wire and web carried thereby becomes separated from the run of said upper wire.

5. The combination of claim 4 wherein at said region wherein said lower wire and web carried thereby become separated from the run of said upper wire, said upper wire run is obliquely ascending.

6. The combination of claim 1 wherein said chute assembly begins at the front edge of said forming shoe.

7. The combination of claim 1 wherein said upper and lower wires meet at the beginning of said twin-wire dewatering zone and form an angle in the range of between about 5° and 30°.

8. The combination of claim 1 wherein said curved member deflects said lower wire over an angle in the range of between about 5° to 30°.

9. The combination of claim 1 wherein said curved, solid-cover forming shoe is at least partially defined by a curved portion having an angle in the range of about 30° to 70°.

10. The combination of claim 9 wherein said angle is about 50°.

11. The combination of claim 1 wherein said curved, solid-cover forming shoe is at least partially defined by a curved portion in the region of which said lower wire and the web carried thereby becomes separated from the run of said upper wire by an angle in the range of about 5° to 30°.

12. The combination of claim 11 wherein said angle is about 20°.

13. The combination of claim 1 wherein said curved, solid-cover forming shoe is at least partially defined by a curved portion in the region of which said lower wire and web carried thereby become separated from the run of said upper wire and said lower wire after said separation runs in an upward oblique direction and defines an angle with the horizontal in the range of about 5° to 15°.

14. The combination of claim 13 wherein said angle is about 10°.

15. The combination of claim 1 wherein said forming shoe is at least partially defined by a curved portion having a radius of curvature and wherein said curved member defining said curved dewatering zone has a radius of curvature and wherein said radii of curvature are substantially equal.

16. The combination of claim 1 further including support means associated with said lower wire and wherein said upper wire unit constitutes an integrated assembly capable of being lifted onto said support means to lie upon said lower wire and move the part from said lower wire such as for changing the upper wire.

17. The combination of claim 1 including a plurality of upper wire units situated one after the other, and wherein each upper wire unit is preceeded by a headbox structure, whereby a multi-ply web can be formed for manufacturing cardboard or a paper web from a plurality of pulp stock jets using the same or different kinds of pulp stock.

* * * * *